US008760059B2

(12) United States Patent
Chou et al.

(10) Patent No.: US 8,760,059 B2
(45) Date of Patent: Jun. 24, 2014

(54) CURRENT-PREHEAT ELECTRONIC BALLAST AND RESONANT CAPACITOR ADJUSTING CIRCUIT THEREOF

(75) Inventors: Ching-Ho Chou, Taoyuan Hsien (TW); Yung-Chuan Lu, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 170 days.

(21) Appl. No.: 13/437,609

(22) Filed: Apr. 2, 2012

(65) Prior Publication Data

US 2013/0076244 A1 Mar. 28, 2013

(30) Foreign Application Priority Data

Sep. 26, 2011 (TW) ..... 100134652 A

(51) Int. Cl.
*H05B 41/295* (2006.01)
*H05B 41/282* (2006.01)

(52) U.S. Cl.
CPC ..... *H05B 41/295* (2013.01); *H05B 41/2827* (2013.01)
USPC ..... 315/116; 315/224; 315/291

(58) Field of Classification Search
None
See application file for complete search history.

(56) References Cited

U.S. PATENT DOCUMENTS

| | | | | |
|---|---|---|---|---|
| 5,565,740 | A * | 10/1996 | Hiramatsu et al. | 315/209 R |
| 5,854,538 | A * | 12/1998 | Krummel | 315/105 |
| 7,176,639 | B2 * | 2/2007 | Hu et al. | 315/209 R |
| 7,239,094 | B2 * | 7/2007 | Radzinski et al. | 315/307 |
| 8,129,920 | B2 * | 3/2012 | Sasakawa | 315/287 |
| 8,159,142 | B2 * | 4/2012 | Chou et al. | 315/210 |
| 8,203,273 | B1 * | 6/2012 | Xiong et al. | 315/94 |
| 8,212,489 | B2 * | 7/2012 | Schmitt | 315/219 |
| 8,324,829 | B2 * | 12/2012 | Nakada et al. | 315/291 |
| 8,339,056 | B1 * | 12/2012 | Xiong et al. | 315/224 |
| 8,344,635 | B2 * | 1/2013 | Gao | 315/224 |
| 2011/0095693 | A1 * | 4/2011 | Nerone et al. | 315/224 |

* cited by examiner

*Primary Examiner* — Alexander H Taningco
*Assistant Examiner* — Nelson Correa
(74) *Attorney, Agent, or Firm* — Kirton McConkie; Evan R. Witt

(57) ABSTRACT

A current-preheat electronic ballast includes an AC-to-DC converter, a controlling unit, an auxiliary voltage generator, and an inverter. The inverter is connected with the DC bus for converting a high DC voltage into an AC output voltage and generating a resonant current and a lamp filament current to a lamp group. The inverter includes a resonant circuit and a resonant capacitor adjusting circuit. The resonant circuit provides electric energy required to preheat the lamp group. The resonant capacitor adjusting circuit judges whether the inverter is enabled according to the detecting element. After the inverter has been enabled for a delayed time, two high-voltage switching terminals of the resonant capacitor adjusting circuit are correspondingly conducted or shut off, so that an equivalent resonant capacitance value of the resonant circuit is changed and a voltage drop across two ends of a lamp filament of the lamp group is changed.

20 Claims, 4 Drawing Sheets

CURRENT-PREHEAT ELECTRONIC BALLAST AND RESONANT CAPACITOR ADJUSTING CIRCUIT THEREOF

FIELD OF THE INVENTION

The present invention relates to an electronic ballast, and more particularly to a current-preheat electronic ballast. The present invention also relates to a resonant capacitor adjusting circuit of the current-preheat electronic ballast.

BACKGROUND OF THE INVENTION

Lighting devices are essential for our daily lives. In recent years, the global economic and commercial activities become more frequent. For improving the quality of home life, the power consumption associated with the lighting devices is gradually increased. For example, the widely-used lighting device is a low pressure gas discharge lamp such as a fluorescent lamp. For achieving the power-saving efficacy, more researchers devote themselves to reduce the power consumption of the low pressure gas discharge lamp. Moreover, the driving circuit of the lighting device is insufficient to meet the diverse requirements. Nowadays, the electronic ballast is designed to have many benefits such as low electromagnetic interference, high efficiency, high power correction factor, no flicker, low weight, high lighting quality and low power consumption.

Generally, the electronic ballasts are classified into two types, i.e. a current-preheat electronic ballast and a voltage-preheat electronic ballast. The conventional current-preheat electronic ballast can provide good starting time sequence to the fluorescent lamp and provide two frequency bands to the fluorescent lamp through a control chip (e.g. a ST L6574 chip). In a case that the current-preheat electronic ballast is operated at a higher frequency band, the lamp filaments of the fluorescent lamp is preheated, wherein the electric energy required to preheat the fluorescent lamp is provided by a resonant circuit of the electronic ballast. Whereas, in a case that the current-preheat electronic ballast is operated at a lower frequency band, the operating current of the fluorescent lamp is stably provided by the electronic ballast.

After the fluorescent lamp is normally operated, the current-preheat electronic ballast will continuously output a stable constant current in order to maintain the luminance of the fluorescent lamp. However, once the operating current flows through the lamp filament of the fluorescent lamp, a voltage drop across the two ends of the lamp filament is generated. Consequently, in a case that the current-preheat electronic ballast is applied to the widely-used fluorescent lamp with low lamp filament impedance (e.g. 2~5 ohms), the voltage drop across the two ends of the lamp filament may be lower than a threshold voltage value (e.g. 4V). Under this circumstance, the life of the lamp filament is not obviously affected. Whereas, in a case that the current-preheat electronic ballast is applied to the high-efficiency fluorescent lamp with high lamp filament impedance (e.g. 8~15 ohms), the voltage drop (e.g. 16V) across the two ends of the lamp filament will be higher than the threshold voltage value. Under this circumstance, the power consumption is increased, the use life of the fluorescent lamp is reduced, and the high-efficiency fluorescent lamp is possibly burnt out.

Therefore, there is a need of providing an improved current-preheat electronic ballast so as to obviate the above drawbacks.

SUMMARY OF THE INVENTION

The present invention provides a current-preheat electronic ballast and a resonant capacitor adjusting circuit thereof in order to reduce the voltage drop across two ends of the lamp filament and extend the life of the lamp group.

The present invention also provides a current-preheat electronic ballast applied to a fluorescent lamp with low lamp filament impedance or a high-efficiency fluorescent lamp with high lamp filament impedance.

In accordance with an aspect of the present invention, there is provided a current-preheat electronic ballast for driving at least one lamp group. The current-preheat electronic ballast includes an AC-to-DC converter, a controlling unit, an auxiliary voltage generator, and an inverter. The AC-to-DC converter is connected with a DC bus for converting an AC input voltage into a high DC voltage and outputting the high DC voltage. The controlling unit is used for controlling operations of the current-preheat electronic ballast. The auxiliary voltage generator is used for generating an auxiliary voltage. The inverter is connected with the DC bus for converting the high DC voltage into an AC output voltage and generating a resonant current and a lamp filament current to the lamp group. The inverter includes a resonant circuit and a resonant capacitor adjusting circuit. The resonant circuit is connected with the lamp group for providing electric energy required to preheat the lamp group, and includes a resonant inductor and a plurality of resonant capacitors. The resonant capacitor adjusting circuit is connected with the resonant circuit and a detecting element. The resonant capacitor adjusting circuit judges whether the inverter is enabled according to the detecting element. After the inverter has been enabled for a delayed time, two high-voltage switching terminals of the resonant capacitor adjusting circuit are correspondingly conducted or shut off, so that an equivalent resonant capacitance value of the resonant circuit is changed and a voltage drop across two ends of a lamp filament of the lamp group is changed.

In accordance with another aspect of the present invention, there is provided a resonant capacitor adjusting circuit for use in an inverter of a current-preheat electronic ballast. The resonant capacitor adjusting circuit includes a first switch element, a control voltage generator, and a time-delaying circuit. The control voltage generator is connected with the detecting element through two detecting terminals of the resonant capacitor adjusting circuit for judging whether the inverter is enabled according to the detecting element and generating a corresponding first DC voltage. The time-delaying circuit is connected with a control terminal of the first switch element and the control voltage generator. According to a level state of the first DC voltage and after a delayed time, the time-delaying circuit generates a second DC voltage at a corresponding level state, thereby controlling whether the first switch element is conducted or not and allowing the two high-voltage switching terminals of the resonant capacitor adjusting circuit to be conducted or shut off.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
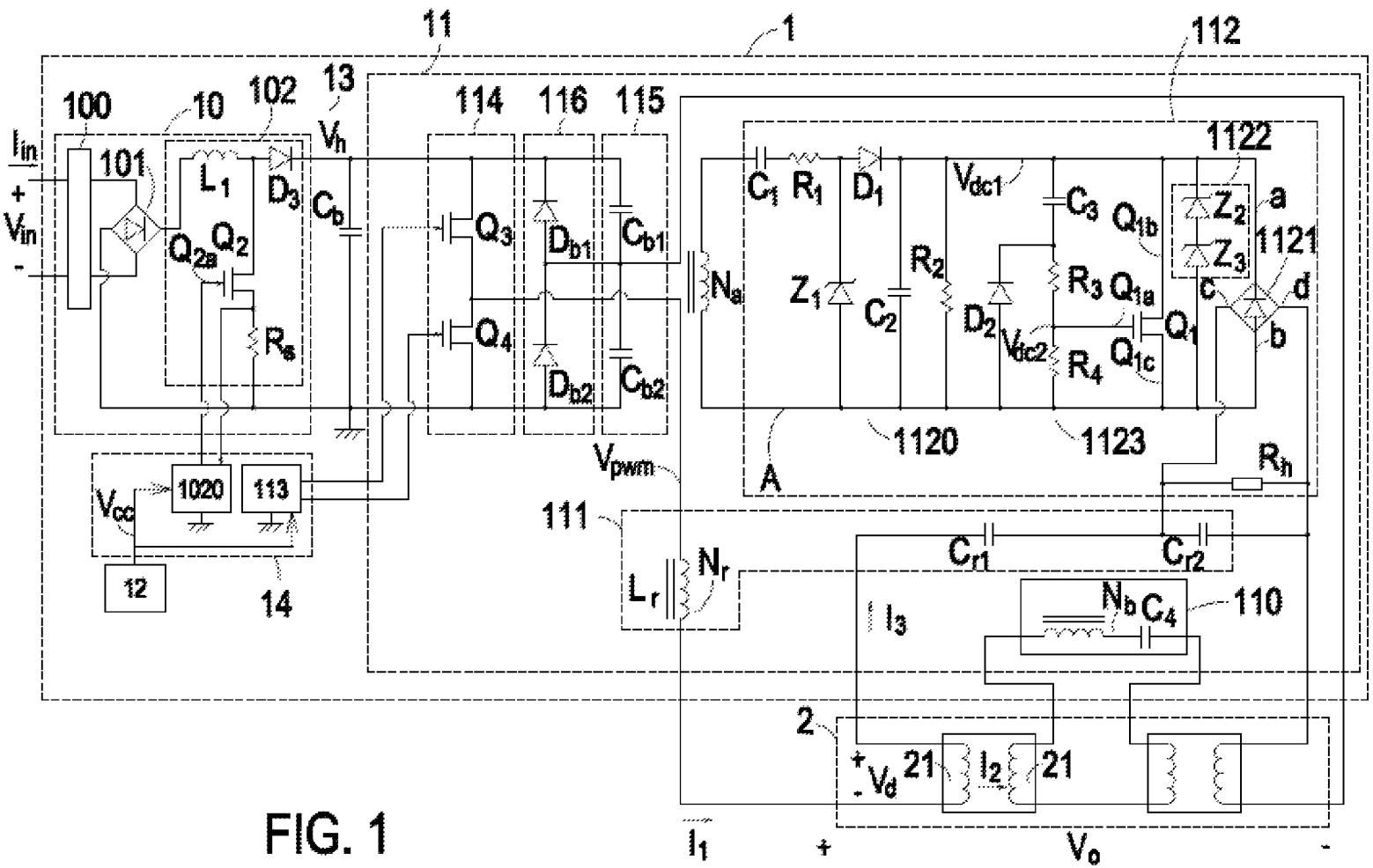
FIG. 1 is a schematic circuit diagram illustrating a current-preheat electronic ballast according to an embodiment of the present invention.

FIG. 1 is a schematic circuit diagram illustrating a current-preheat electronic ballast according to an embodiment of the present invention. As shown in FIG. 1, the current-preheat electronic ballast 1 is connected with a plurality of lamp groups 2. Each of the lamp groups 2 comprises at least one lamp filament 21. As shown in FIG. 1, the current-preheat electronic ballast 1 comprises an AC-to-DC converter 10, an inverter 11, an auxiliary voltage generator 12, a controlling unit 14, and a bus capacitor $C_b$. In this embodiment, the lamp group 2 comprises two or more serially-connected gas discharge lamps. Alternatively, the lamp group 2 comprises two or more gas discharge lamps, which are connected with each other in parallel.

The AC-to-DC converter 10 is used for converting an AC input voltage $V_{in}$ into a high DC voltage $V_h$. The AC-to-DC converter 10 has an input side and an output side. The AC input voltage $V_{in}$ is received by the input side of the AC-to-DC converter 10. The output side of the AC-to-DC converter 10 is connected to a DC bus 13 for outputting the high DC voltage $V_h$ (e.g. 450V). The input side of the inverter 11 is connected with the DC bus 13 for converting the high DC voltage $V_h$ into an AC output voltage $V_o$ and generating a resonant current $I_1$ and a lamp filament current $I_3$ to the lamp groups 2. The resonant current $I_1$ is equal to the sum of a lamp current $I_2$ and the lamp filament current $I_3$, i.e. $I_1=I_2+I_3$.

In this embodiment, the inverter 11 comprises a preheating circuit 110, a resonant circuit 111, and a resonant capacitor adjusting circuit 112. The preheating circuit 110 is connected with the serially-connected side of the lamp filaments 21 of the lamp group 2. The preheating circuit 110 is used for preheating the serially-connected side of the lamp filaments 21 of the lamp group 2. The resonant circuit 111 is used for providing the electric energy for preheating, igniting and illuminating the lamp group 2. In this embodiment, the resonant circuit 111 comprises a resonant inductor $L_r$, a first resonant capacitor $C_{r1}$, and a second resonant capacitor $C_{r2}$. The resonant inductor $L_r$ is connected with one of the lamp filaments 21 of the lamp group 2. The first resonant capacitor $C_{r1}$, and the second resonant capacitor $C_{r2}$ are serially connected between two lamp filaments 21 of the lamp group 2. The capacitance value of the first resonant capacitor $C_{r1}$, is higher than the capacitance value of the second resonant capacitor $C_{r2}$. The two high-voltage switching terminals of the resonant capacitor adjusting circuit 112 are connected with the resonant circuit 111. The two detecting terminals of the resonant capacitor adjusting circuit 112 are connected with a detecting element (e.g. an auxiliary winding $N_a$ of the resonant inductor $L_r$). In this embodiment, the resonant capacitor adjusting circuit 112 comprises a control voltage generator 1120, a time-delaying circuit 1123, a full-bridge rectifier circuit 1121, and a first switch element $Q_1$. By turning on or turning off the first switch element $Q_1$ in a delayed manner, the equivalent resonant capacitance value $C_t$ of the resonant circuit 111 that is connected with the high-voltage switching terminals of the resonant capacitor adjusting circuit 112 is correspondingly changed. The auxiliary voltage generator 12 is used for generating an auxiliary voltage $V_{cc}$ (e.g. 5V), and providing electric energy to the power factor correction (PFC) control circuit 1020 and the inverter control circuit 113 of the controlling unit 14. The bus capacitor $C_b$ is connected with the DC bus 13 for filtering off the high-frequency noise contained in the high DC voltage $V_h$.

In accordance with a key feature of the present invention, the resonant capacitor circuit (i.e. the first resonant capacitor $C_{r1}$ and the second resonant capacitor $C_{r2}$) of the resonant circuit 111 are serially connected with the lamp filaments 21. The two switching terminals of the resonant capacitor adjusting circuit 112 are connected with the second resonant capacitor $C_{r2}$ of the resonant circuit 111 in parallel. When the lamp group 2 is turned on, the operation of the resonant capacitor adjusting circuit 112 can change the equivalent resonant capacitance value $C_t$ of the resonant circuit 111, so that the lamp filament current $I_3$ is changed. Under this circumstance, the reactive power through the lamp filaments 21 and the resonant circuit 111 is changed, and thus the amplitude of the voltage drop (lamp filament voltage $V_d$) across the two ends of the lamp filament 2 will be changed.

Please refer to FIG. 1 again. The AC-to-DC converter 10 comprises an electromagnetic interference filtering unit 100, a first rectifier circuit 101, and a power factor correction circuit 102. The electromagnetic interference filtering unit 100 is used for receiving the AC input voltage $V_{in}$. The AC side of the first rectifier circuit 101 is connected with the electromagnetic interference filtering unit 100. The DC side of the first rectifier circuit 101 is connected with the input side of the power factor correction circuit 102. The output side of the power factor correction circuit 102 is connected with the DC bus 13.

The electromagnetic interference filtering unit 100 is configured for blocking the high-frequency noise contained in the current-preheat electronic ballast 1 and the high-frequency noise contained in AC input voltage $V_{in}$, thereby preventing the electromagnetic interference. During operations of the AC-to-DC converter 10, the AC input voltage $V_{in}$ converted into a full-wave DC voltage by the first rectifier circuit 101. Then, by alternately turning on or turning off the second switch element $Q_2$ of the power factor correction circuit 102, the full-wave DC voltage is increased to the high DC voltage $V_h$. The power factor correction circuit 102 comprises a first inductor $L_1$, a third diode $D_3$, the detecting resistor $R_s$, and the second switch element $Q_2$. A first end of the first inductor $L_1$ is connected with a positive terminal of the DC side of the first rectifier circuit 101. A second end of the first inductor $L_1$ is connected with an anode of the third diode $D_3$. The cathode of the third diode $D_3$ is connected with the DC bus 13. The second switch element $Q_2$ is connected with the detecting resistor $R_s$, the first inductor $L_1$ and the third diode $D_3$. The power factor correction control circuit 1020 is connected with the control terminal $Q_{2a}$ of the second switch element $Q_2$. By controlling the on/off statuses of the second switch element $Q_2$, the distribution of the AC input current $I_{in}$ is similar to the waveform of the AC input voltage $V_{in}$, and thus the power factor is increased.

In this embodiment, the inverter 11 further comprises a power switching circuit 114 and a voltage divider circuit 115. The inverter control circuit 113 is connected with the power switching circuit 114 and the auxiliary voltage generator 12 for controlling operations of the power switching circuit 114, so that the serially-connected terminal of the power switching circuit 114 generates a pulse width modulation voltage $V_{pwm}$. The voltage divider circuit 115 is connected with the DC bus 13 for generated a divided voltage ($V_h/2$). The power switching circuit 114 comprises a third switch element $Q_3$ and a fourth switch element $Q_4$. The third switch element $Q_3$ and the fourth switch element $Q_4$ are serially connected with each other. The voltage divider circuit 115 comprises a first voltage divider capacitor $C_{b1}$ and a second voltage divider capacitor $C_{b2}$. The first voltage divider capacitor $C_{b1}$ and the second voltage divider capacitor $C_{b2}$ are serially connected with each other. The serially-connected terminal of the power switching circuit 114 and the serially-connected terminal of the voltage divider circuit 115 are connected with the resonant circuit 111 and the lamp groups 2. By alternately turning on or turning off the third switch element $Q_3$ and a fourth switch element $Q_4$ of the inverter 11, the high DC voltage $V_h$ is converted into the AC output voltage $V_o$.

In this embodiment, the preheating circuit 110 comprises a second auxiliary winding $N_b$ and a fourth capacitor $C_4$, wherein the second auxiliary winding $N_b$ and the resonant inductor $L_r$ have the collective core. Moreover, the preheating circuit 110 is serially connected with the serially-connected terminal of the lamp groups for preheating the lamp filaments 21 of the lamp groups 2.

In this embodiment, the resonant capacitor adjusting circuit 112 successively comprises the control voltage generator 1120, the time-delaying circuit 1123, the first switch element $Q_1$ and the full-bridge rectifier circuit 1121. By means of the auxiliary winding $N_a$ of the resonant inductor $L_r$ (i.e. the detecting element), the control voltage generator 1120 judges whether the inverter 11 is enabled, and generate a first DC voltage $V_{dc1}$ at a corresponding level state. According to the level state of the first DC voltage $V_{dc1}$, the time-delaying circuit 1123 generates a second DC voltage $V_{dc2}$ at a corresponding level state after a delayed time, thereby controlling whether the first switch element $Q_1$ is conducted or not.

In this embodiment, the control voltage generator 1120 comprises a first capacitor $C_1$, a second capacitor $C_2$, a first resistor $R_1$, a second resistor $R_2$, and a first Zener diode $Z_1$. The time-delaying circuit 1123 comprises a second diode $D_2$, a third capacitor $C_3$, a third resistor $R_3$, and a fourth resistor $R_4$. The first end of the auxiliary winding $N_a$ is connected with a first end of the first capacitor $C_1$ and a first connecting node A. The second end of the first capacitor $C_1$ is connected with a first end of the first resistor $R_1$. The second end of the first resistor $R_1$ is connected with the anode of a first diode $D_1$ and a cathode of the first Zener diode $Z_1$. The anode of the first Zener diode $Z_1$ is connected with the first connecting node A. The cathode of the first diode $D_1$ is connected with a first end of the second capacitor $C_2$, the first end of the second resistor $R_2$ and the first end of the third capacitor $C_3$. The second end of the third capacitor $C_3$, the second end of the second resistor $R_2$, the anode of the second diode $D_2$ and the first end of the fourth resistor $R_4$ are connected with the first connecting node A. The cathode of the second diode $D_2$ is connected with the second end of the third capacitor $C_3$ and the first end of the third resistor $R_3$. The second end of the third resistor $R_3$ is connected with the second end of the fourth resistor $R_4$.

An example of the first switch element $Q_1$ includes but is not limited to a metal oxide semiconductor field effect transistor (MOSFET). The control terminal $Q_{1a}$ of the first switch element $Q_1$ is connected with the second end of the third resistor $R_3$ and the second end of the fourth resistor $R_4$. The current input terminal $Q_{1b}$ of the first switch element $Q_1$ is connected with the first terminal "a" (DC positive terminal) of the full-bridge rectifier circuit 1121. The current output terminal $Q_{1c}$ of the first switch element $Q_1$ is connected with the second first terminal "b" (DC positive terminal) of the full-bridge rectifier circuit 1121. The third terminal "c" and the fourth terminal "d" (i.e. the two terminals of the AC side) of the full-bridge rectifier circuit 1121 are respectively connected to the two ends of the second resonant capacitor $C_{r2}$. That is, the third terminal "c" and the fourth terminal "d" of the full-bridge rectifier circuit 1121 are connected with the second resonant capacitor $C_{r2}$ in parallel.

Figure 2:
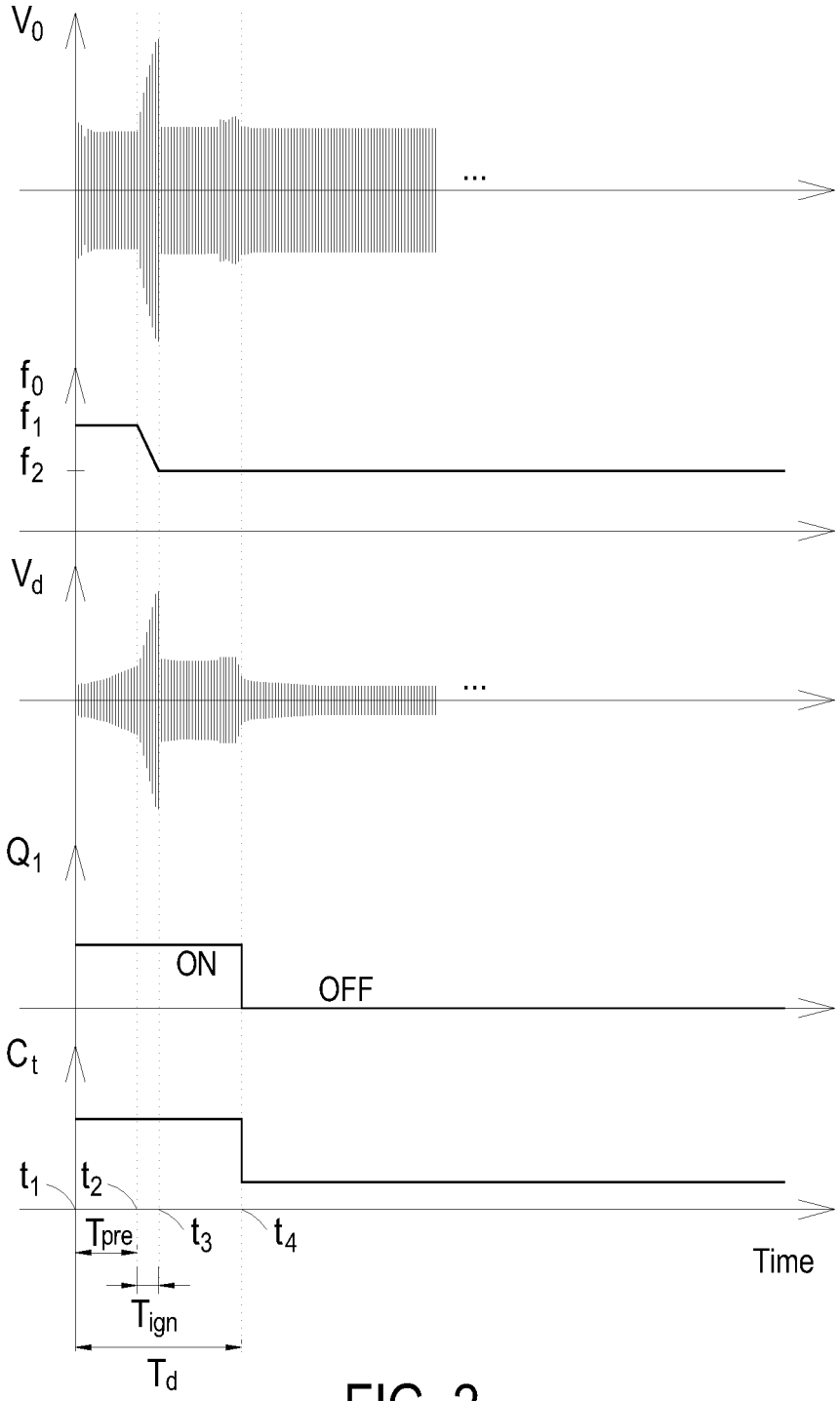
FIG. 2 is a schematic timing waveform diagram illustrating associated voltage signals processed in the current-preheat electronic ballast of FIG. 1.

FIG. 2 is a schematic timing waveform diagram illustrating associated voltage signals processed in the current-preheat electronic ballast of FIG. 1. At the time spot $t_1$ when the current-preheat electronic ballast 1 receives the AC input voltage $V_{in}$ and is activated, the controlling unit 14 controls the operations of the power switching circuit 114. Consequently, the inverter 11 outputs the AC output voltage $V_o$ with a higher first frequency value $f_1$ (e.g. 65 k Hz) and the resonant current I, and the lamp groups 2 are preheated. Since the lamp group 2 has not be lighted up at this moment, no lamp current $I_2$ is generated. Moreover, since the resonant current $I_1$ is transmitted to the first resonant capacitor $C_{r1}$ through the lamp filaments 21 at this moment, the resonant current $I_1$ is equal to the lamp filament current $I_3$. For providing a higher magnitude of the lamp filament current $I_3$ to preheat the lamp filaments 21, the two high-voltage switching terminals of the resonant capacitor adjusting circuit 112 are conducted during the preheat time period $T_{pre}$. That is, the first switch element $Q_1$ is conducted. Consequently, the equivalent resonant capacitance value $C_t$ is equal to the higher capacitance value of the first resonant capacitor $C_{r1}$.

At the time spot $t_1$, the resonant current $I_1$ of the resonant winding $N_r$ is detected by the auxiliary winding $N_a$ (i.e. the detecting element), so that electric energy is generated. The electric energy is transmitted to the cathode of the second diode $D_2$ through the first capacitor $C_1$ and the first resistor $R_1$, so that the first DC voltage $V_{dc1}$ is at an enabling state (e.g. at a high-level state). The enabling state (e.g. at a high-level state) indicates that the inverter 11 is enabled. Meanwhile, the third capacitor $C_3$ is charged by the first DC voltage $V_{dc1}$ at the enabling state. Since the third capacitor $C_3$ is nearly short-circuited in the initial stage, the voltage value of the third capacitor $C_3$ is 0V. Consequently, after the first DC voltage $V_{dc1}$ is subject to voltage division by the third resistor $R_3$ and the fourth resistor $R_4$, a second DC voltage $V_{dc2}$ ($V_{dc2}>V_t$) is not immediately changed to a disabling state (e.g. at a low-level state). That is, the magnitude of the second DC voltage $V_{dc2}$ is higher than the threshold voltage $V_t$ of the first switch, so that the second DC voltage $V_{dc2}$ is maintained at the high-level state (i.e. at the enabling state). Under this circumstance, the first switch element $Q_1$ is conducted. Meanwhile, the lamp filament current $I_3$ does not flow through the second resonant capacitor $C_{r2}$. After the lamp filament current $I_3$ flows through the first resonant capacitor $C_{r1}$, the lamp filament current $I_3$ is inputted into the full-bridge rectifier circuit 1121 through the third terminal "c" and outputted from the first terminal "a". After the lamp filament current $I_3$ flows through the conducted first switch element $Q_1$, the lamp filament current $I_3$ is inputted into the full-bridge rectifier circuit 1121 through the second terminal "b" and outputted from the fourth terminal "d". The lamp filament current $I_3$ is inputted into another end of the lamp group 2. The loop of the lamp filament current $I_3$ may be referred as a positive half cycle of the lamp filament current $I_3$.

During a negative half cycle of the lamp filament current $I_3$, the lamp filament current $I_3$ is inputted into the full-bridge rectifier circuit 1121 through the fourth terminal "d" and outputted from first terminal "a", then transmitted through the conducted first switch element $Q_1$, then inputted into the full-bridge rectifier circuit 1121 through the second terminal "b" and outputted from third terminal "c", and finally inputted into an end of the lamp group 2 through the first resonant capacitor $C_{r1}$.

During the ignition time period $T_{ign}$ from the time spot $t_2$ to the time spot $t_3$, the operation of the power switching circuit 114 is controlled by the controlling unit 14. Consequently, the frequency value $f_o$ of the AC output voltage $V_o$ or the resonant current $I_1$ is gradually reduced from the higher first frequency value $f_1$ (e.g. 65 k Hz) to a lower second frequency value $f_2$ (e.g. 40 k Hz). In such way, the resonant circuit 111 is operated at the lower second frequency value $f_2$ and has a high gain value. Under this circumstance, the AC output voltage $V_o$ with the high amplitude is able to ignite the lamp group 2.

After the processes of preheating and igniting the lamp group 2 are completed, the third capacitor $C_3$ is continuously charged by the first DC voltage $V_{dc1}$. Consequently, the voltage value of the third capacitor $C_3$ is gradually increased. Meanwhile, the magnitude of the second DC voltage $V_{dc2}$ is correspondingly reduced. Meanwhile, the second DC voltage $V_{dc2}$ ($V_{dc2}>V_t$) is maintained at an enabling state (e.g. at a high-level state).

At the time $t_4$, the magnitude of the second DC voltage $V_{dc2}$ is lower than the threshold voltage $V_t$ of the first switch ($V_{dc2}<V_t$). Consequently, the second DC voltage $V_{dc2}$ is at the disabling state (i.e. at the low-level state). Meanwhile, since the electric energy is no longer transmitted to the control terminal $Q_{1a}$ of the first switch element $Q_1$, the first switch element $Q_1$ is at the open state. That is, the second resonant capacitor $C_{r2}$ is no longer bypassed by the resonant capacitor adjusting circuit 112. The lamp filament current $I_3$ is inputted into another end of the lamp group 2 through the first resonant capacitor $C_{r1}$ and the second resonant capacitor $C_{r2}$, thereby defining a loop. Meanwhile, the first resonant capacitor $C_{r1}$ and the second resonant capacitor $C_{r2}$ are serially connected with each other to define the equivalent resonant capacitance value $C_t$. In other words, the resonant inductor $L_r$, the first resonant capacitor $C_{r1}$ and the second resonant capacitor $C_{r2}$ are serially connected with each other. Consequently, the equivalent resonant capacitance value $C_t$ is lower than the capacitance value of the first resonant capacitor $C_{r1}$ ($C_t<C_{r1}$). Under this circumstance, the magnitude of the lamp filament current $I_3$ is reduced, the voltage drop across the two ends of the lamp filament 21 is reduced, the life of the lamp group is prolonged, and the power consumption is reduced. In a case that the current-preheat electronic ballast is applied to the high-efficiency fluorescent lamp with high lamp filament impedance, the possibility of burning out the high-efficiency fluorescent lamp will be minimized. Since the lamp filament current $I_3$ flowing through the lamp filament 21 results in the reactive power, the magnitude of the lamp current $I_2$ is not influenced. Consequently, the magnitude of the lamp current $I_2$ may be maintained at a constant value.

From the above discussions, the auxiliary winding $N_a$ (i.e. the detecting element) of the control voltage generator 1120 judges that the inverter 11 is enabled at the time spot $t_1$. Consequently, the first DC voltage $V_{dc1}$ is at an enabling state (e.g. at a high-level state), but the enabling state (e.g. the high-level state) of the second DC voltage $V_{dc2}$ is not immediately changed by the time-delaying circuit 1123. After the delayed time $T_d$ (i.e. at the time spot $t_4$), the second DC voltage $V_{dc2}$ is changed to a disabling state (e.g. at a low-level state). Consequently, the first switch element $Q_1$ is at the open state, and the lamp filament current $I_3$ and the lamp filament voltage $V_d$ are both reduced. Since the delayed time $T_d$ is greater than or equal to the sum of the preheat time period $T_{pre}$ and the ignition time period $T_{ign}$ ($T_d>T_{pre}+T_d$), the equivalent resonant capacitance value $C_t$ ($C_t=C_{r1}$) of the resonant circuit 111 is higher. In other words, during the preheat time period $T_{pre}$ and the ignition time period $T_{ign}$, the equivalent resonant capacitance value $C_t$ of the resonant circuit 111 is higher, and the performance of the inverter 11 is enhanced. After the preheat time period and the ignition time period of the lamp group 2, the equivalent resonant capacitance value $C_t$ is lowered ($C_t<C_{r1}$). Consequently, the lamp filament current $I_3$ and the lamp filament voltage $V_d$ are both reduced.

In some embodiments, the resonant capacitor adjusting circuit 112 can be a four-pin resonant capacitor adjusting element, which is produced by a semiconductor fabricating process. The four-pin resonant capacitor adjusting element comprises two detecting terminals and two high-voltage switching terminals, which are connected with the detecting element and the resonant circuit, respectively. Consequently, component number and the volume of the current-preheat electronic ballast will be reduced.

In this embodiment, the first switch element $Q_1$ and the full-bridge rectifier circuit 1121 of the resonant capacitor adjusting circuit 112 are operated at low frequency to achieve the switching properties of the two switching terminals. Consequently, in a case that the first switch element $Q_1$ is applied to a high frequency (e.g. >40 k Hz) inverter 11, the first switch element $Q_1$ can be normally conducted and shut off. In a case that the resonant capacitor adjusting circuit 112 is applied to a low frequency inverter 11, the unidirectional first switch element $Q_1$ and the full-bridge rectifier circuit 1121 may be replaced by a bidirectional switch element (not shown). For example, the bidirectional switch element is a triode thyristor switch (TRIAC). The control terminal of the bidirectional switch element is connected with the output terminal of the time-delaying circuit 1123 (i.e. the serially-connected terminal of the third resistor $R_3$ and the fourth resistor $R_4$), and the two switching terminals of the bidirectional switch element are served as the two switching terminals of the resonant capacitor adjusting circuit 112.

Please refer to FIG. 1 again. The inverter 11 further comprises a protection circuit 116. When the lamp group 2 has a breakdown, the protection circuit 116 is able to protect the current-preheat electronic ballast 1. The protection circuit 116 comprises a first protection diode $D_{b1}$ and a second protection diode $D_{b2}$, which are respectively connected with the first voltage divider capacitor $C_{b1}$ and the second voltage divider capacitor $C_{b2}$ of the voltage divider circuit 115. In a case that the lamp group 2 has a breakdown, the lamp group 2 discharges electricity asymmetrically during the positive or negative half cycle of the AC output voltage $V_o$. For example, if the protection circuit 116 is not included, the voltage value of the first voltage divider capacitor $C_{b1}$ or the second voltage divider capacitor $C_{b2}$ is possibly too high (e.g. higher than the voltage value of the high DC voltage $V_h$) during the positive half cycle. On the other hand, if the protection circuit 116 is included, the current-preheat electronic ballast 1 can be effectively protected. For example, if the magnitude of the second voltage divider capacitor $C_{b2}$ is higher than the magnitude of the high DC voltage $V_h$, the second protection diode $D_{b2}$ connected with the second voltage divider capacitor $C_{b2}$ will be conducted. Meanwhile, the second voltage divider capacitor $C_{b2}$ is no longer continuously charged, and thus the magnitude of the second voltage divider capacitor $C_{b2}$ is not too high. Under this circumstance, the possibility of damaging the first voltage divider capacitor $C_{b1}$ or the second voltage divider capacitor $C_{b2}$ will be minimized.

In this embodiment, the resonant capacitor adjusting circuit 112 further comprises a clamping circuit 1122. The clamping circuit 1122 is connected to two switching terminals $Q_{1b}$ and $Q_{1c}$ of the first switch element $Q_1$ for protecting the first switch element $Q_1$. The clamping circuit 1122 comprises a second Zener diode $Z_2$ and a third Zener diode $Z_3$, which are connected with each other in series. Due to the clamping circuit 1122, the high voltage instantaneously generated when the process of preheating the lamp group 2 will be suppressed, and the possibility of damaging the first switch element $Q_1$ will be minimized.

In this embodiment, the inverter 11 further comprises a thermistor $R_h$. The thermistor $R_h$ is connected with the two switching terminals of the resonant capacitor adjusting circuit 112 in parallel. In the initial operating stage of the current-preheat electronic ballast 1 (i.e. before the time spot $t_1$), the first switch element $Q_1$ is switched from the open state to the close state during a short time. Since the thermistor $R_h$ is operated at a low temperature (e.g. 25° C.) and has a low resistance value, the thermistor $R_h$ can shortly bypass the second resonant capacitor $C_{r2}$ in replace of the first switch element $Q_1$. Consequently, the equivalent resonant capacitance value $C_t$ ($C_t$=$C_{r1}$) of the resonant circuit 111 is higher, and the lamp filament 21 is preheated by a high magnitude of the lamp filament current $I_3$. Under this circumstance, the short flicker resulting from the low equivalent resonant capacitance value before the lamp group 2 is preheated will be eliminated. After the lamp group 2 is lighted up, the thermistor $R_h$ is operated at a high temperature (e.g. 100° C.) and has a high resistance value. Under this circumstance, the thermistor $R_h$ is nearly at the open state without the bypassing property, and thus the performance of the resonant circuit 111 is not adversely affected.

Figure 3:
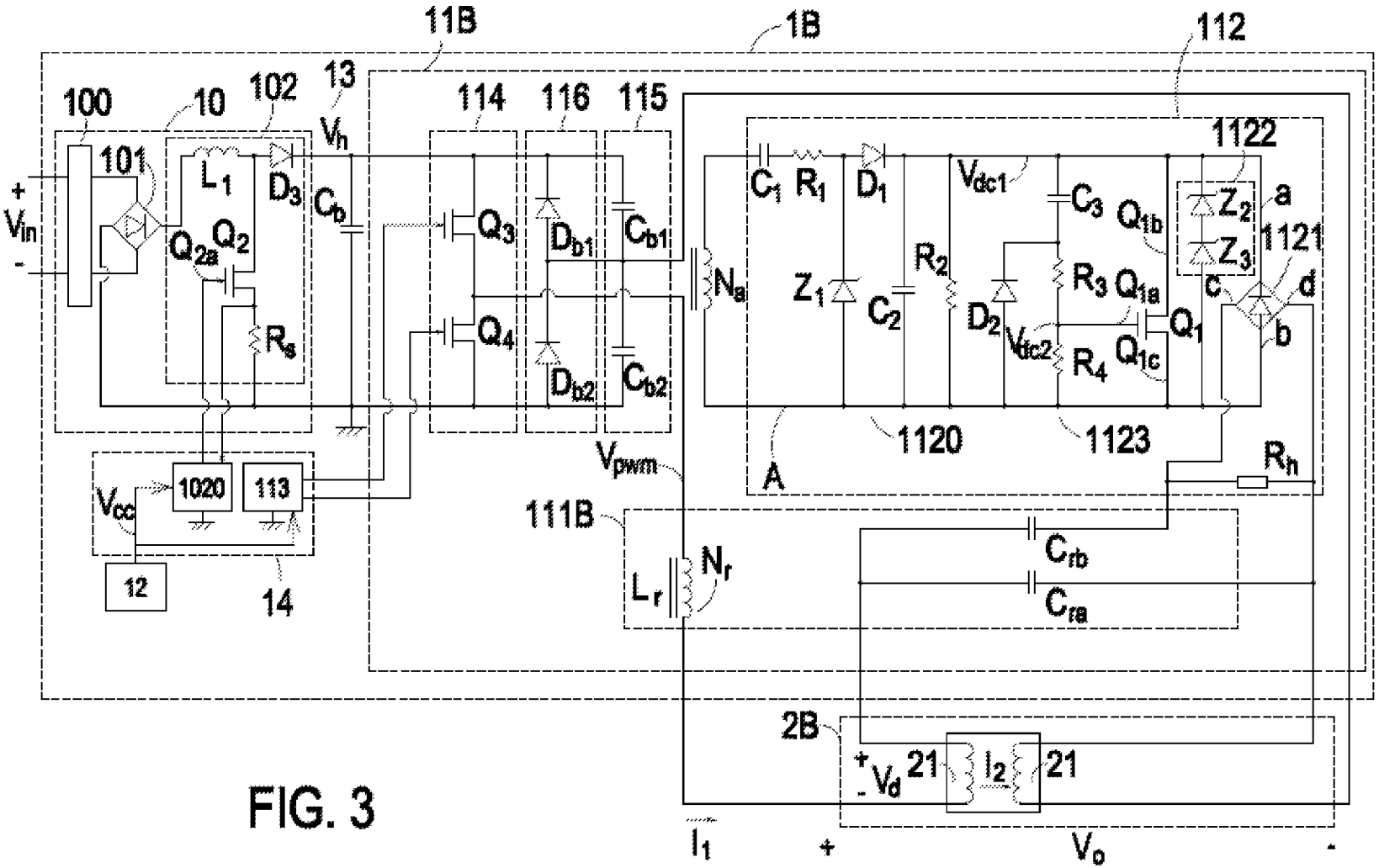
FIG. 3 is a schematic circuit diagram illustrating a current-preheat electronic ballast according to another embodiment of the present invention.

FIG. 3 is a schematic circuit diagram illustrating a current-preheat electronic ballast according to another embodiment of the present invention. In comparison with the current-preheat electronic ballast of FIG. 1, the lamp group 2B and the resonant circuit 111B are distinguished. In this embodiment, the lamp group 2B has a single lamp. The two high-voltage switching terminals of the resonant capacitor adjusting circuit 112 are serially connected with the second resonant capacitor $C_{rb}$. By conducting or shutting off the two high-voltage switching terminals of the resonant capacitor adjusting circuit 112, the first resonant capacitor $C_{ra}$ and the second resonant capacitor $C_{rb}$ are selectively connected between the two lamp filaments 21 in parallel. Similarly, during the preheat time period $T_{pre}$ and the ignition time period $T_{ign}$, the two high-voltage switching terminals of the resonant capacitor adjusting circuit 112 are conducted. That is, the first switch element $Q_1$ is conducted. Consequently, the equivalent resonant capacitance value $C_t$ is higher. That is, the equivalent resonant capacitance value $C_t$ is equal to the sum of the first resonant capacitor $C_{ra}$ and the second resonant capacitor $C_{rb}$. After the delayed time $T_d$ (i.e. at the time spot $t_4$), the lamp group 2 has been preheated and lighted up. Meanwhile, the two high-voltage switching terminals of the resonant capacitor adjusting circuit 112 are in the open state. Consequently, the equivalent resonant capacitance value $C_t$ is lower. That is, the equivalent resonant capacitance value $C_t$ is equal to the capacitance value of the first resonant capacitor $C_{ra}$ (i.e. $C_t$=$C_{ra}$). Moreover, if the capacitance value of the first resonant capacitor $C_{ra}$ is smaller than the capacitance value of the second resonant capacitor $C_{rb}$, the performance of the current-preheat electronic ballast 1B is enhanced.

Figure 4:
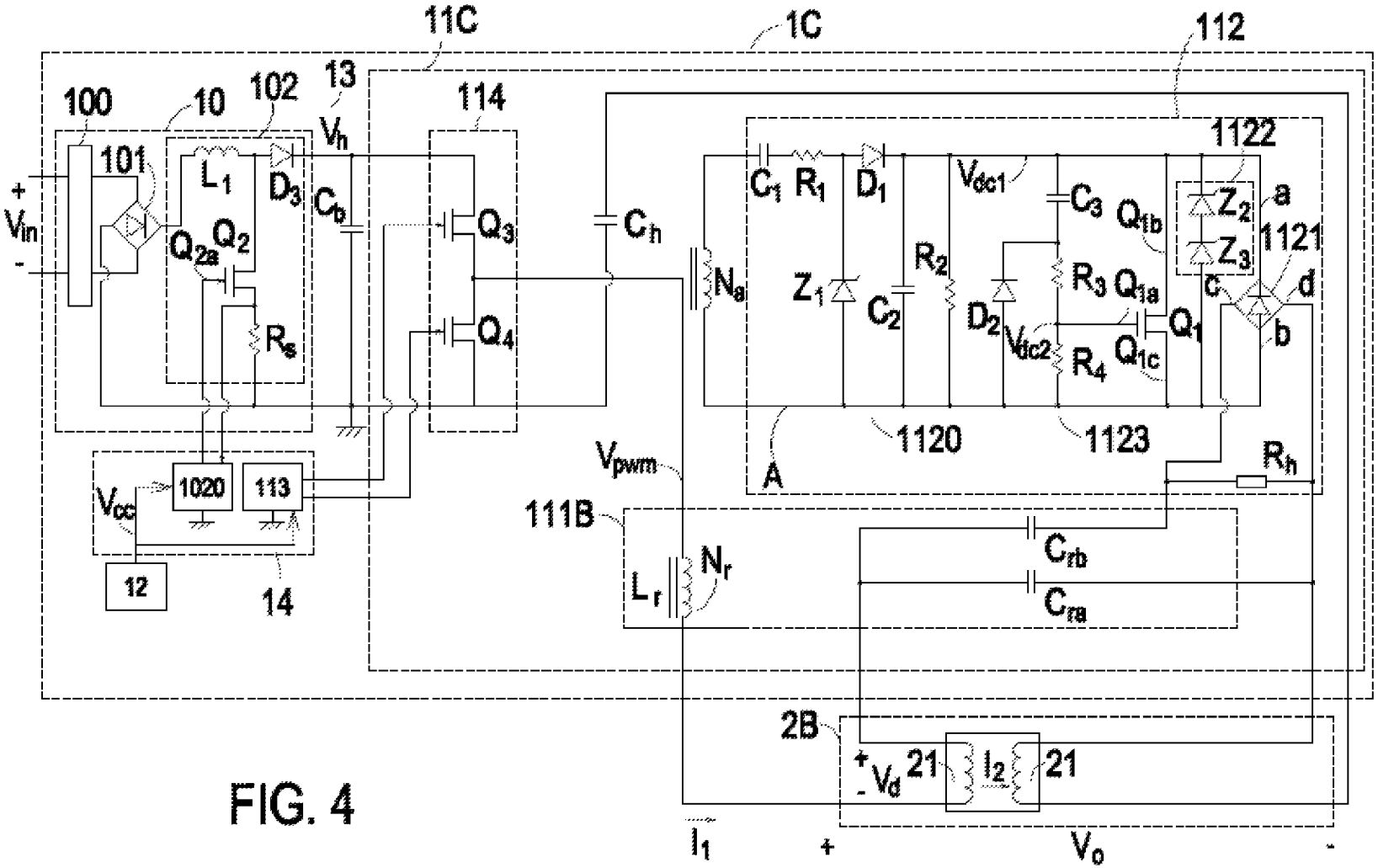
FIG. 4 is a schematic circuit diagram illustrating a current-preheat electronic ballast according to a further embodiment of the present invention.

FIG. 4 is a schematic circuit diagram illustrating a current-preheat electronic ballast according to a further embodiment of the present invention. In comparison with FIG. 3, the inverter 11C is distinguished. In this embodiment, the power switching circuit 114 is operated at a duty cycle of 50%, the voltage divider circuit 115 may be simplified into or equivalent to a half-bridge capacitor $C_h$. The half-bridge capacitor $C_h$ is serially connected with the resonant circuit 111B. The operating principles are similar to those illustrated above, and are not redundantly described herein.

From the above description, the current-preheat electronic ballast is capable of adjusting the equivalent resonant capacitance value of a resonant circuit by means of a resonant capacitor adjusting circuit. Consequently, the equivalent resonant capacitance value before the preheat time period and the ignition time period and the equivalent resonant capacitance value after the preheat time period and the ignition time period are different. In such way, the lamp filament current is high during the preheat time period and the ignition time period. Moreover, after the preheat time period and the ignition time period, the lamp filament current is reduced, so that the voltage drop across two ends of the lamp filament is reduced (e.g. <4V). Consequently, the power consumption is reduced, and the life of the lamp group is prolonged. In other words, the current-preheat electronic ballast can be simultaneously applied to the fluorescent lamp with low lamp filament impedance and the high-efficiency fluorescent lamp with high lamp filament impedance. Moreover, since the resonant capacitor adjusting circuit can be operated at a high-frequency environment, the resonant capacitor adjusting circuit is applicable to the high-frequency current-preheat electronic ballast. Due to the delaying property, the equivalent resonant capacitance value of a resonant circuit of the current-preheat electronic ballast is changed after the fluorescent lamp is lighted up. Consequently, the lamp filament current is reduced, and the voltage drop across two ends of the lamp filament is reduced (e.g. <4V).

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A current-preheat electronic ballast for driving at least one lamp group, said current-preheat electronic ballast comprising:

an AC-to-DC converter connected with a DC bus for converting an AC input voltage into a high DC voltage and outputting said high DC voltage;

a controlling unit for controlling operations of said current-preheat electronic ballast;

an auxiliary voltage generator for generating an auxiliary voltage; and an inverter connected with said DC bus for converting said high DC voltage into an AC output voltage and generating a resonant current and a lamp filament current to said lamp group, wherein said inverter comprises:

a resonant circuit connected with said lamp group for providing electric energy required to preheat said lamp group, and comprising a resonant inductor and a plurality of resonant capacitors, wherein said plurality of resonant capacitors are coupled in series; and a resonant capacitor adjusting circuit connected with said resonant circuit and a detecting element, wherein said resonant capacitor adjusting circuit judges whether said inverter is enabled according to said detecting element, wherein after said inverter has been enabled for a delayed time, two high-voltage switching terminals of said resonant capacitor adjusting circuit are correspondingly conducted or shut off, so that an equivalent resonant capacitance value of said resonant circuit is changed and a voltage drop across two ends of a lamp filament of said lamp group is changed.

2. The current-preheat electronic ballast according to claim 1 wherein said AC-to-DC converter comprises:

an electromagnetic interference filtering unit;

a first rectifier circuit connected with said electromagnetic interference filtering unit; and a power factor correction circuit connected with said first rectifier circuit and said DC bus.

3. The current-preheat electronic ballast according to claim 1 wherein said inverter further comprises a voltage divider circuit, which is connected with said DC bus for generating a divided voltage, wherein said voltage divider circuit comprises a first voltage divider capacitor and a second voltage divider capacitor, which are serially connected with each other.

4. The current-preheat electronic ballast according to claim 3 wherein said inverter further comprises a protection circuit, which comprises a first protection diode and a second protection diode, wherein said first protection diode and said second protection diode are respectively connected with said first voltage divider capacitor and said second voltage divider capacitor for preventing overvoltage of said first voltage divider capacitor and said second voltage divider capacitor.

5. The current-preheat electronic ballast according to claim 2 wherein said controlling unit comprises:

a power factor correction control circuit for controlling said power factor correction circuit; and an inverter control circuit for controlling operations of said inverter.

6. The current-preheat electronic ballast according to claim 1 wherein said resonant capacitor adjusting circuit comprises:

a first switch element;

a control voltage generator connected with said detecting element for judging whether said inverter is enabled according to said detecting element and generating a corresponding first DC voltage; and a time-delaying circuit connected with a control terminal of said first switch element and said control voltage generator, wherein according to a level state of said first DC voltage and after said delayed time, said time-delaying circuit generates a second DC voltage at a corresponding level state, thereby controlling whether said first switch element is conducted or not.

7. The current-preheat electronic ballast according to claim 6 wherein said first switch element is a bidirectional switch element or a unidirectional switch element.

8. The current-preheat electronic ballast according to claim 6 wherein said first switch element is a unidirectional switch element, and said resonant capacitor adjusting circuit further comprises a full-bridge rectifier circuit, wherein two AC terminal of said full-bridge rectifier circuit are respectively connected with two high-voltage switching terminals of said resonant capacitor adjusting circuit, and two DC terminals of said full-bridge rectifier circuit are respectively connected with two switching terminals of said first switch element.

9. The current-preheat electronic ballast according to claim 8 wherein said resonant capacitor adjusting circuit further comprises a clamping circuit, which is connected to switching terminals of said first switch element for protecting said first switch element, wherein said clamping circuit comprises at least one Zener diode.

10. The current-preheat electronic ballast according to claim 6 wherein said control voltage generator comprises a first capacitor, a second capacitor, a first resistor, a second resistor and a first Zener diode, wherein said detecting element is connected with a first end of said first capacitor and a first connecting node, a second end of said first capacitor is connected with a first end of said first resistor, and a second end of said first resistor is connected with an anode of said first diode and a cathode of said first Zener diode, wherein an anode of said first Zener diode is connected with said first connecting node, and a cathode of said first diode is connected with a first end of said second capacitor and a first end of said second resistor.

11. The current-preheat electronic ballast according to claim 10 wherein said time-delaying circuit comprises a second diode, a third capacitor, a third resistor and a fourth resistor, wherein a first end of said third capacitor is connected with said first diode, said second capacitor and said second resistor, wherein a second end of said third capacitor, a second end of said second resistor, an anode of said second diode and a first end of said fourth resistor are connected with said first connecting node, wherein an cathode of said second diode is connected with a second end of said third capacitor and a first end of said third resistor, and a second end of said third resistor is connected with a second end of said fourth resistor.

12. The current-preheat electronic ballast according to claim 1 wherein said inverter further comprises a power switching circuit, wherein said power switching circuit is connected with said controlling unit, said DC bus and said resonant circuit for generating a pulse width modulation voltage to said resonant circuit.

13. The current-preheat electronic ballast according to claim 1 wherein said power switching circuit is operated at a duty cycle of 50%, wherein said inverter further comprises a half-bridge capacitor, which is serially connected with the resonant circuit, wherein said half-bridge capacitor is equivalent to two voltage divider capacitors.

14. The current-preheat electronic ballast according to claim 1 wherein said detecting element is an auxiliary winding, wherein said auxiliary winding and said resonant inductor have a collective core.

15. The current-preheat electronic ballast according to claim 1 wherein said inverter further comprises a preheating circuit, which is connected with said lamp group for preheating said lamp group.

16. The current-preheat electronic ballast according to claim 1 wherein said inverter further comprises a thermistor, which is connected with two high-voltage switching terminals of said resonant capacitor adjusting circuit.

17. The current-preheat electronic ballast according to claim 1 wherein a resonant capacitor circuit of said resonant circuit is connected with two terminals of said lamp group, wherein said resonant capacitor circuit comprises a first resonant capacitor and a second resonant capacitor, wherein said second resonant capacitor is connected with two high-voltage switching terminals of said resonant capacitor adjusting circuit in series or in parallel.

18. A resonant capacitor adjusting circuit for use in an inverter of a current-preheat electronic ballast, said inverter comprising a resonant circuit connected with said resonant capacitor adjusting circuit and a lamp group for providing electric energy required to preheat said lamp group, said resonant circuit comprising a resonant inductor and a plurality of resonant capacitors, wherein said plurality of resonant capacitors are coupled in series, said resonant capacitor adjusting circuit comprising:

a first switch element;

a control voltage generator connected with a detecting element through two detecting terminals of said resonant capacitor adjusting circuit for judging whether said inverter is enabled according to said detecting element and generating a corresponding first DC voltage; and a time-delaying circuit connected with a control terminal of said first switch element and said control voltage generator, wherein according to a level state of said first DC voltage and after a delayed time, said time-delaying circuit generates a second DC voltage at a corresponding level state, thereby controlling whether said first switch element is conducted or not and allowing two high-voltage switching terminals of said resonant capacitor adjusting circuit to be conducted or shut off, so that an equivalent resonant capacitance value of said resonant circuit is changed and a voltage drop across two ends of a lamp filament of said lamp group is changed.

19. The resonant capacitor adjusting circuit according to claim 18 wherein said resonant capacitor adjusting circuit is a resonant capacitor adjusting element having a plurality of terminals, and said first switch element is a bidirectional switch element or a unidirectional switch element.

20. The resonant capacitor adjusting circuit according to claim 18 further comprising a full-bridge rectifier circuit, wherein two AC terminal of said full-bridge rectifier circuit are respectively connected with two high-voltage switching terminals of said resonant capacitor adjusting circuit, and two DC terminals of said full-bridge rectifier circuit are respectively connected with two switching terminals of said first switch element.

* * * * *